US005147132A

United States Patent [19]

Lee

[11] Patent Number: 5,147,132

[45] Date of Patent: Sep. 15, 1992

[54] SWIVEL MEANS FOR LIGHTING FIXTURE

[75] Inventor: Chia-Yu Lee, Taipei, Taiwan

[73] Assignee: Sangara Industrial Co., Ltd., Taipei, Taiwan

[21] Appl. No.: 863,697

[22] Filed: Apr. 2, 1992

[51] Int. Cl.[5] ..... F21S 3/02

[52] U.S. Cl. ..... 362/426; 362/288; 362/413; 362/427; 362/402

[58] Field of Search ..... 362/285, 287, 288, 413, 362/414, 426, 402, 427

[56] References Cited

U.S. PATENT DOCUMENTS

| | | | |
|---|---|---|---|
| 4,449,172 | 5/1984 | Warshawsky | 362/427 |
| 4,692,849 | 9/1987 | Le Vantine | 362/402 |
| 4,974,135 | 11/1990 | Wen-tsung | 362/427 X |

*Primary Examiner*—Stephen F. Husar

[57] ABSTRACT

A swivel means for lighting fixture includes: a swivel base having a lower post secured on a supporting base of a lighting fixture, an upper bracket having a collar rotatably mounted on the swivel base as packed by a packing sleeve sandwiched between the supporting base and the collar and having an upper post secured with a lampshade provided with an illuminator in the lampshade, a tensioning spring resiliently holding the collar of the upper bracket on the swivel base, whereby upon a swinging rotation of the lampshade secured with the upper bracket and the collar about a horizontal axis of the swivel base, the lampshade will be angularly rotated to adjust its inclination angle about a horizontal axis longitudinally formed in the swivel base to be optionally angularly positioned on the swivel base as frictionally held on the swivel base by the packing sleeve and resiliently held on the swivel base by the tensioning spring.

8 Claims, 3 Drawing Sheets

SWIVEL MEANS FOR LIGHTING FIXTURE

BACKGROUND OF THE INVENTION

Jerome Warshawsky discloses a vertical swing bracket in his U.S. Pat. No. 4,449,169, which involves vertical swing brackets for swing arm lamps; and contemplates forming the vertical swing bracket to support, position and retain each swing unit, (to which a swing arm is to be connected) in such a manner that each swing unit rotates about a vertical axis of rotation, and all such vertical axes of rotation are disposed to be parallel, one with respect to the other.

However, Warshawsky's device can only allow a lamp or lampshade to be rotated about a vertical axis, rather than a horizontal axis, so that his lamp can not be used for adjusting a projecting orientation of inclination, for any angular degrees about a horizon for projecting light either upwardly, horizontally or downwardly, thereby limiting its commerical uses. For instance, if a light from a lamp should be optionally adjusted for its projecting inclination, such as a track light or decorative light used in a commercial show room for display purpose, how can the Warshawsky's device be provided for such an illuminating purpose?

It is therefore expected to dispose a swivel means of a lighting fixture which can be used for optionally adjusting an inclination of a lamp.

SUMMARY OF THE INVENTION

The object of the present invention is to provide a swivel means for lighting fixture including: a swivel base having a lower post secured on a supporting base of a lighting fixture, an upper bracket having a collar rotatably mounted on the swivel base as packed by a packing sleeve sandwiched between the supporting base and the collar and having an upper post secured with a lampshade provided with an illuminator in the lampshade, a tensioning spring resiliently holding the collar of the upper bracket on the swivel base, whereby upon a swinging rotation of the lampshade secured with the upper bracket and the collar about a horizontal axis of the swivel base, the lampshade will be angularly rotated to adjust its inclination angle about a horizontal axis longitudinally formed in the swivel base to be optionally angularly positioned on the swivel base as frictionally held on the swivel base by the packing sleeve and resiliently held on the swivel base by the tensioning spring.

DETAILED DESCRIPTION

Figure 1:
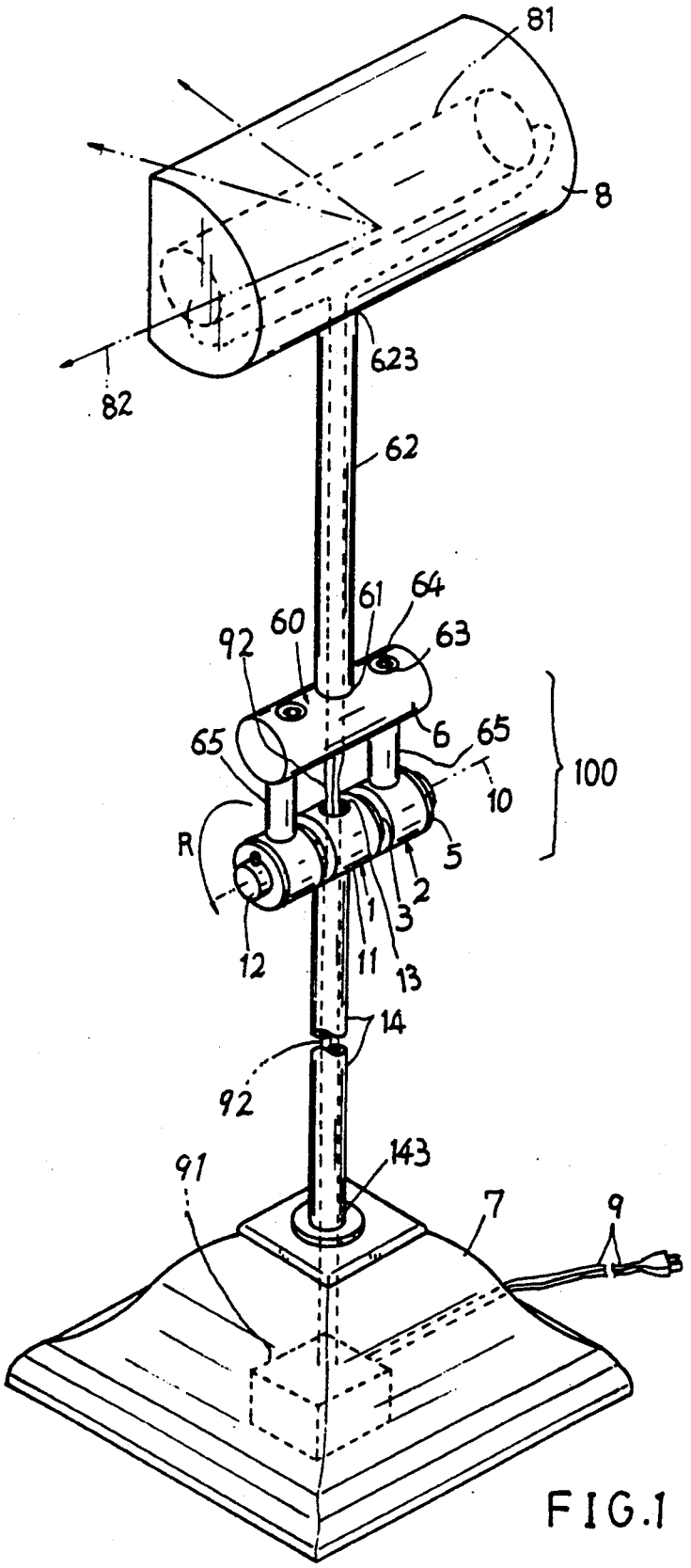
FIG. 1 is a perspective illustration of the present invention.
Figure 2:
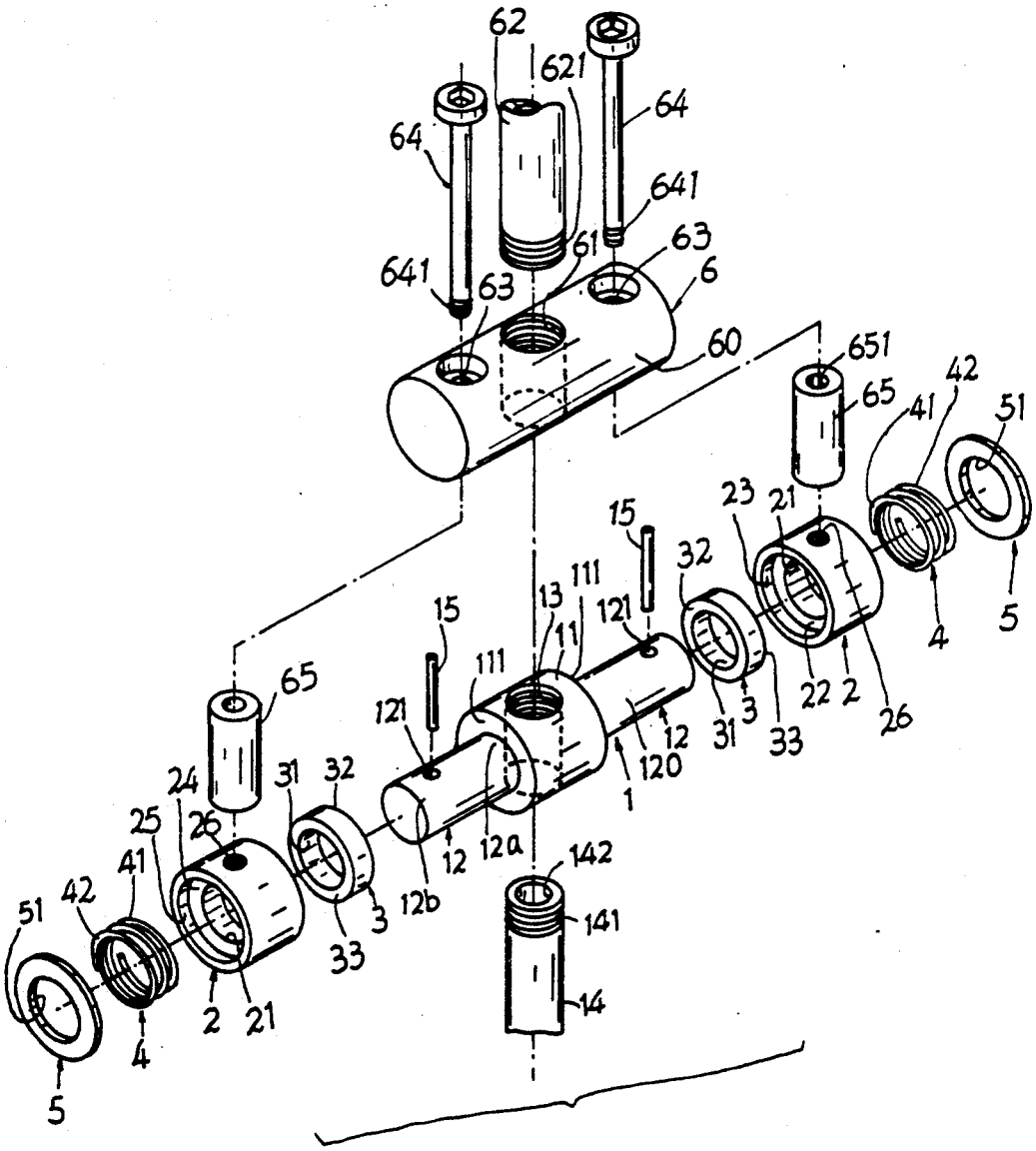
FIG. 2 is an exploded view showing all elements in construction of the present invention.
Figure 3:
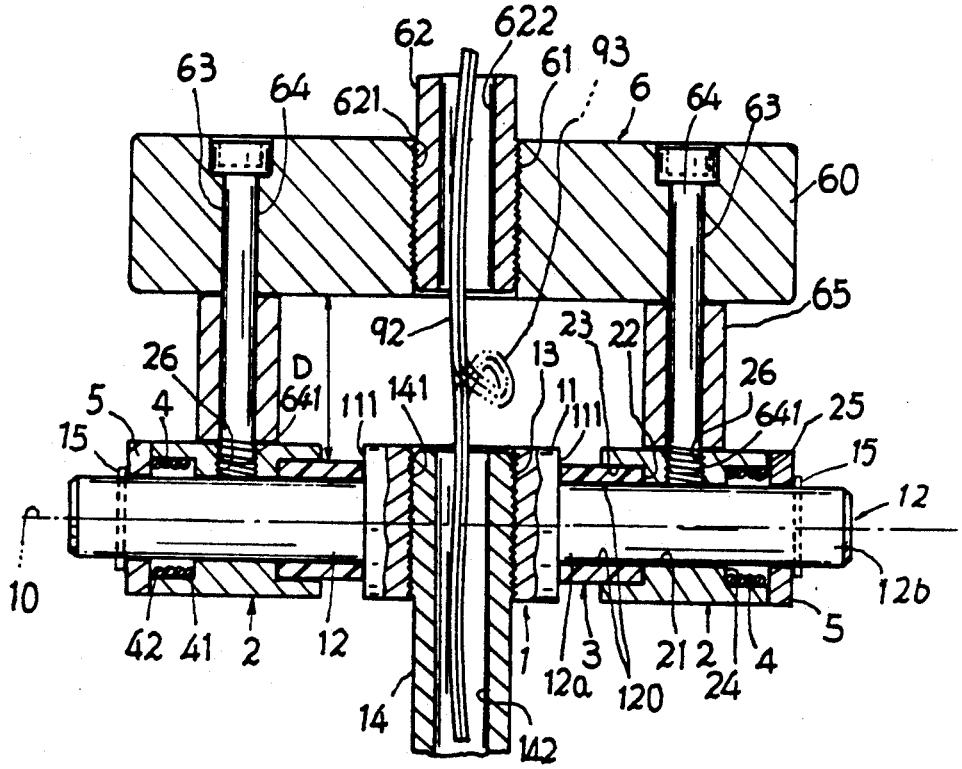
FIG. 3 is a sectional drawing of the present invention when assembled.

As shown in FIGS. 1-3, a swivel means for a lighting fixture 100 of the present invention comprises: a swivel base 1, a pair of supporting collars 2, a pair of packing sleeves 3, a pair of tensioning springs 4, a pair of retainer washers 5, an upper bracket 6 normally positioned above the swivel base 1, a supporting base 7, a lampshade 8 provided with an illuminator 81 in the lampshade, and a power source 9.

The swivel base 1 includes: a first block portion 11 having a pair of shaft members 12 protruding rightwardly and leftwardly from the first block portion 11, a central block hole 13 vertically formed in a central portion of the first block portion 11, and a lower post 14 having an upper post end portion 141 engaged with the central block hole 13, a lower post end portion 143 secured on the supporting base 7 and a central post hole 142 longitudinally formed through the lower post 14.

The swivel base 1 defines a horizontal axis 10 longitudinally formed in a horizontal center of the swivel base with the horizontal axis 10 being perpendicular to the lower post 14.

The central block hole 13 may be female threaded to be engageable with a male-threaded portion formed on the upper post end portion 141.

Two supporting collars 2 are respectively rotatably mounted on said two shaft members 12, each supporting collar 2 including: a central collar hole 21 longitudinally formed through the collar 2 and rotatably engageable with a cylindrical surface 120 circumferentially formed on each shaft member 12, an inner cylindrical hole 23 formed in an inner end portion of the collar 2 and enlarged from and communicated with the central collar hole 21, an inner shoulder portion 22 annularly formed inside the collar 2 defined between the inner cylindrical hole 23 and the central collar hole 21, an outer cylindrical hole 25 formed in an outer end portion of the collar 2 opposite to the inner cylindrical hole 23 and enlarged from and communicated with the central collar hole 21, an outer shoulder portion 24 annularly formed inside the collar 2 defined between the outer cylindrical hole 25 and the central cylindrical hole 21, and a bolt retaining hole 26 formed in a central upper portion of the collar 2.

Each packing sleeve 3 frictionally rotatably held on an inner shaft end **12*a* of each shaft member 12 is made of elastomer having good resistance to friction such as rubber, and includes a central sleeve hole 31 rotatably engageable with each shaft member 12, an inner ring portion 32 formed on an inner end portion of the sleeve 3 in contact with a block shoulder portion 111 formed on a side portion of the first block portion 11, and an outer ring portion 33 formed on an outer end portion of the sleeve 3 inserted in the inner cylindrical hole 23 of the collar 2 as limited by the inner shoulder portion 22 of the collar 2 for frictionally rotatably holding the collar 2 on the cylindrical surface 120 of the shaft member 12**.

Each tensioning spring 4 held in the outer cylindrical hole 25 of each collar 2 includes an inner spring end 41 resiliently contacting the outer shoulder portion 24 and an outer spring end 42 resiliently limited by each retainer washer 5 retained on an outer shaft end **12*b* of the shaft member 12**.

Each retainer washer 5 has a central washer hole 51 engageable with the cylindrical surface 120 of the shaft member 12. The washer 5 is retained on the outer shaft end **12*b* of the shaft member 12 by a stopper pin 15 inserted in a pin hole 121 formed in the shaft member 12 for retaining the outer spring end 42 of the tensioning spring 4**.

The upper bracket 6 includes: a second block portion 60 radially disposed about the horizontal axis 10 of the swivel base 1 and separated from the first block portion 11 with a distance D (FIG. 3), a central bracket hole 61 formed in a central portion through the second block portion 60, an upper post 62 having a first end portion 621 fixed into the central bracket hole 61 of the second block portion 60, a second end portion 623 secured with the lampshade 8, and a central through hole 622 formed through the upper post 62, a pair of bolts 64 respectively inserted in a pair of bolt holes 63 formed on two opposite side portions of the second block portion 60 each bolt 64 having a tail end portion 641 fixed into the bolt retaining hole 26 formed in the collar 2, and a bolt tube 65 having a tube hole 651 disposed around the bolt 64 and retained between the second block portion 60 and the collar 2.

The first end portion 621 of the upper post 62 may be formed with male threads to be engaged with the female threads formed in the central bracket hole 61.

The power source 9 includes an electrical cord 92 connected to a municipal power source or other sources having two wires with respect to two electrical poles of the power source passing through the central holes 142, 622 of the two posts 14, 62, and a transformer adapter 91 mounted in the supporting base 7 for stepping down an input power voltage such as from 110 volts to 12 volts or 24 volts. The electrical cord 92 may be formed with a flexible cord portion 93 positioned in the space D between the first block portion 11 and the second block portion 60 as shown in dotted line of FIG. 3 serving a buffer for angularly rotating the upper bracket 6 about the swivel base 1 without breaking or damaging the electrical cord 92.

In using the present invention as shown in FIG. 1, the illuminator or lamp 81 held in the lampshade 8 may be held to rotate the upper post 62, the upper bracket 6 and the collars 2 about the shaft members 12 (substantially about the axis 10 of the base 1) in direction R so as to adjust an inclination of the lampshade and a light projecting direction 82 emitted from the illuminator 81 for angular lighting purpose. After adjusting to a desired position or orientation, the collars 2 secured with the post 62 and the lampshade 8 will be "braked" on the shaft members 12 of the swivel base 1 due to a frictional holding of the packing sleeve 3 sandwiched between the collar 2 and the shaft member 12 and due to a resilient holding by the tensioning spring 4 retained between the collar 2 and the shaft member 12 as limited by the washer 5 and pin 15.

Therefore the present invention is superior to a conventional vertically rotating swing bracket such as taught by U.S. Pat. No. 4,449,169 with an optional inclination adjustment and an optional stopping, braking or positioning of an electric lamp (illuminator) at the adjusted inclination.

I claim:

1. A swivel means for lighting fixture comprising:

a swivel base secured on a supporting base of a lighting fixture of an electric lamp;

an upper bracket secured with a lampshade having an illuminator electrically connected to a power source and held in said lampshade, and rotatably mounted on said swivel base;

at least a packing sleeve packed between said swivel base and said upper bracket for frictionally holding and positioning said upper bracket secured with said lampshade when optionally rotating said upper bracket about said swivel base; and at least a tensioning spring retained in between said swivel base and said upper bracket for resiliently holding said upper bracket and said lampshade on said swivel base after angularly rotating said upper bracket about said swivel base.

2. A swivel means according to claim 1, wherein said swivel base includes: a first block portion having a pair of shaft members protruding rightwardly and leftwardly from the first block portion, a central block hole vertically formed in a central portion of the first block portion, and a lower post having an upper post end portion engaged with the central block hole, a lower post end portion secured on the supporting base and a central post hole longitudinally formed through the lower post; said swivel base defining a horizontal axis longitudinally formed in a horizontal center of the swivel base with the horizontal axis being perpendicular to the lower post.

3. A swivel means according to claim 2, wherein two supporting collars are respectively rotatably mounted on said two shaft members, each said supporting collar including: a central collar hole longitudinally formed through the collar and rotatably engageable with a cylindrical surface circumferentially formed on each shaft member, an inner cylindrical hole formed in an inner end portion of the collar and enlarged from and communicated with the central collar hole, an inner shoulder portion annularly formed inside the collar defined between the inner cylindrical hole and the central collar hole, an outer cylindrical hole formed in an outer end portion of the collar opposite to the inner cylindrical hole and enlarged from and communicated with the central collar hole, an outer shoulder portion annularly formed inside the collar defined between the outer cylindrical hole and the central cylindrical hole, and a bolt retaining hole formed in a central upper portion of the collar.

4. A swivel means according to claim 3, wherein each said packing sleeve is made of elastomer having good resistance to friction, and includes a central sleeve hole rotatably engageable with each shaft member, an inner ring portion formed on an inner end portion of the sleeve in contact with a block shoulder portion formed on a side portion of the first block portion, and an outer ring portion formed on an outer end portion of the sleeve inserted in the inner cylindrical hole of the collar as limited by the inner shoulder portion of the collar for frictionally rotatably holding the collar on the cylindrical surface of the shaft member.

5. A swivel means according to claim 3, wherein each said tensioning spring held in the outer cylindrical hole of each collar includes an inner spring end resiliently contacting the outer shoulder portion of said collar and an outer spring end resiliently limited by each said retainer washer retained on an outer shaft end of the shaft member.

6. A swivel means according to claim 5, wherein each said retainer washer has a central washer hole engageable with the cylindrical surface of the shaft member, said washer retained on the outer shaft end of the shaft member by a stopper pin for retaining the outer spring end of the tensioning spring.

7. A swivel means according to claim 3, wherein said upper bracket includes: a second block portion radially disposed about the horizontal axis of the swivel base and separated from the first block portion with a distance, a central bracket hole formed in a central portion through the second block portion, an upper post having a first end portion fixed into the central bracket hole of the second block portion, a second end portion secured with the lampshade, and a central through hole formed through the upper post, a pair of bolts respectively inserted in a pair of bolt holes formed on two opposite side portions of the second block portion each said bolt having a tail end portion fixed into the bolt retaining hole formed in said collar, and a bolt tube disposed around the bolt and retained between the second block portion and the collar.

8. A swivel means according to claim 7, wherein said power source includes an electrical cord having a flexible cord portion positioned in a space between the first block portion of said swivel base and the second block portion of said upper bracket serving a buffer for angularly rotating the upper bracket about the swivel base without breaking or damaging the electrical cord.

* * * * *